US010533778B2

(12) United States Patent
Morgan

(10) Patent No.: US 10,533,778 B2
(45) Date of Patent: Jan. 14, 2020

(54) TURBO ECONOMIZER USED IN CHILLER SYSTEM

(71) Applicant: Daikin Applied Americas Inc., Minneapolis, MN (US)

(72) Inventor: Jeffrey Allen Morgan, Fishersville, VA (US)

(73) Assignee: DAIKIN APPLIED AMERICAS INC., Minneapolis, MN (US)

( * ) Notice: Subject to any disclaimer, the term of this patent is extended or adjusted under 35 U.S.C. 154(b) by 536 days.

(21) Appl. No.: 15/156,548

(22) Filed: May 17, 2016

(65) Prior Publication Data

US 2017/0336106 A1 Nov. 23, 2017

(51) Int. Cl.
*F25B 1/10* (2006.01)
*F25B 11/04* (2006.01)
(Continued)

(52) U.S. Cl.
CPC ..... *F25B 1/10* (2013.01); *F01D 5/141* (2013.01); *F25B 11/00* (2013.01); *F25B 11/04* (2013.01);
(Continued)

(58) Field of Classification Search
CPC .. F01D 5/141; F25B 1/10; F25B 11/04; F25B 2400/13; F25B 11/00; F25B 2339/0242;
(Continued)

(56) References Cited

U.S. PATENT DOCUMENTS 5,317,882 A * 6/1994 Ritenour ..... F25B 1/00 415/72
5,497,635 A * 3/1996 Alsenz ..... F01D 1/32 415/80
(Continued)

FOREIGN PATENT DOCUMENTS

EP 1067342 A2 1/2001
JP 2010180859 A * 8/2010
(Continued)

OTHER PUBLICATIONS

The International Search Report for the corresponding international application No. PCT/US2017/032642 dated Aug. 3, 2017.
(Continued)

*Primary Examiner* — Henry T Crenshaw
*Assistant Examiner* — Kamran Tavakoldavani
(74) *Attorney, Agent, or Firm* — Global IP Counselors, LLP

(57) ABSTRACT

A turbo economizer adapted to be used in a chiller system includes a nozzle, a turbine, and an economizer impeller. The nozzle introduces refrigerant into the turbo economizer. The turbine is disposed downstream of the nozzle, and the turbine is attached to a shaft rotatable about a rotation axis. A flow of the refrigerant introduced through the nozzle drives the turbine to rotate the shaft. The economizer impeller is attached to the shaft so as to be rotated in accordance with rotation of the shaft. In the turbo economizer, the nozzle reduces a pressure of the refrigerant such that a pressure of the refrigerant entering the turbo economizer is lower than
(Continued)

a predetermined pressure, at least some of the refrigerant passes through the nozzle is introduced into the economizer impeller, and the economizer impeller increases a pressure of the refrigerant introduced thereinto to the predetermined pressure.

14 Claims, 11 Drawing Sheets

(51) Int. Cl.

| | |
|---|---|
| ***F01D 5/14*** | (2006.01) |
| ***F25B 11/00*** | (2006.01) |
| ***F25B 39/00*** | (2006.01) |
| ***F25B 43/00*** | (2006.01) |
| *F25B 27/00* | (2006.01) |
| *F25B 39/02* | (2006.01) |

(52) U.S. Cl.
CPC ..... *F25B 39/00* (2013.01); *F25B 43/00* (2013.01); *F25B 27/00* (2013.01); *F25B 39/02* (2013.01); *F25B 2339/0242* (2013.01); *F25B 2341/0662* (2013.01); *F25B 2400/0751* (2013.01); *F25B 2400/13* (2013.01); *F25B 2400/14* (2013.01); *F25B 2400/141* (2013.01); *F25B 2400/23* (2013.01)

(58) Field of Classification Search
CPC ..... F25B 27/00; F25B 2341/0662; F25B 2400/23; F25B 2400/0751
See application file for complete search history.

(56) References Cited

U.S. PATENT DOCUMENTS

| | | | | |
|---|---|---|---|---|
| 5,561,987 | A * | 10/1996 | Hartfield | B01D 1/04 165/117 |
| 6,122,915 | A * | 9/2000 | Hays | B01D 17/00 60/641.2 |
| 6,443,697 | B1 * | 9/2002 | Rossi | F01D 5/34 415/202 |
| 6,644,062 | B1 * | 11/2003 | Hays | F01D 15/08 62/402 |
| 2007/0295673 | A1 * | 12/2007 | Enis | C02F 1/10 210/766 |
| 2008/0098754 | A1 | 5/2008 | Sommer et al. | |
| 2010/0071391 | A1 * | 3/2010 | Lifson | F25B 1/10 62/115 |

FOREIGN PATENT DOCUMENTS

| | | | |
|---|---|---|---|
| WO | 9004107 | A1 | 4/1990 |
| WO | 2008079128 | A1 | 7/2008 |

OTHER PUBLICATIONS

International Preliminary Report on Patentability including Written Opinion for the corresponding international application No. PCT/US2017/032642, dated Nov. 20, 2018.

* cited by examiner p-h diagram (Typical)

p-h diagram (Present Invention)

p-h diagram (Typical)

p-h diagram (Present Invention)

TURBO ECONOMIZER USED IN CHILLER SYSTEM

BACKGROUND

Field of the Invention

The present invention generally relates to a turbo economizer for a chiller system.

Background Information

A chiller system is a refrigerating machine or apparatus that removes heat from a medium. Commonly a liquid such as water is used as the medium and the chiller system operates in a vapor-compression refrigeration cycle. This liquid can then be circulated through a heat exchanger to cool air or equipment as required. As a necessary byproduct, refrigeration creates waste heat that must be exhausted to ambient or, for greater efficiency, recovered for heating purposes. A conventional chiller system often utilizes a centrifugal compressor, which is often referred to as a turbo compressor. Thus, such chiller systems can be referred to as turbo chillers. Alternatively, other types of compressors, e.g. a screw compressor, can be utilized.

In a conventional (turbo) chiller, refrigerant is compressed in the centrifugal compressor and sent to a heat exchanger in which heat exchange occurs between the refrigerant and a heat exchange medium (liquid). This heat exchanger is referred to as a condenser because the refrigerant condenses in this heat exchanger. As a result, heat is transferred to the medium (liquid) so that the medium is heated. Refrigerant exiting the condenser is expanded by an expansion valve and sent to another heat exchanger in which heat exchange occurs between the refrigerant and a heat exchange medium (liquid). This heat exchanger is referred to as an evaporator because refrigerant is heated (evaporated) in this heat exchanger. As a result, heat is transferred from the medium (liquid) to the refrigerant, and the liquid is chilled. The refrigerant from the evaporator is then returned to the centrifugal compressor and the cycle is repeated. The liquid utilized is often water.

A conventional centrifugal compressor basically includes a casing, an inlet guide vane, an impeller, a diffuser, a motor, various sensors and a controller. Refrigerant flows in order through the inlet guide vane, the impeller and the diffuser. Thus, the inlet guide vane is coupled to a gas intake port of the centrifugal compressor while the diffuser is coupled to a gas outlet port of the impeller. The inlet guide vane controls the flow rate of refrigerant gas into the impeller. The impeller increases the velocity of refrigerant gas. The diffuser works to transform the velocity of refrigerant gas (dynamic pressure), given by the impeller, into (static) pressure. The motor rotates the impeller. The controller controls the motor, the inlet guide vane and the expansion valve. In this manner, the refrigerant is compressed in a conventional centrifugal compressor.

In order to improve the efficiency of the chiller system, an economizer has been used. See for example U.S. Patent Application Publication No. 2008/0098754. The economizer separates refrigerant gas from two-phase (gas-liquid) refrigerant, and the refrigerant gas is introduced to an intermediate pressure portion of the compressor.

SUMMARY

It has been discovered that, in a conventional economizer, the pressure of refrigerant gas leaving the economizer is reduced to the intermediate pressure so that the refrigerant gas is introduced into the intermediate portion of the compressor. The cooling capacity in the chiller system can be increased as the intermediate pressure of the compressor is lowered. According to one conventional technique, the compressor may have two impellers of different sizes in which the impeller at the first stage has a smaller size and the impeller at the second stage has a larger size so as to achieve the low intermediate pressure of the refrigerant in the compressor. While this technique works relatively well, this system requires a large-sized compressor to allow the size difference in the impellers, which results in increased costs.

Therefore, one object of the present invention is to provide a turbo economizer which achieves the improved cooling capacity in a chiller system without using impellers of different sizes in the compressor.

Another object of the present invention is to provide a self-powered turbo economizer without using a separate motor.

Yet another object of the present invention is to provide a turbo economizer which further improves the cooling capacity by using an expander.

Yet another object of the present invention is to provide a chiller system which uses the turbo economizer in accordance with the present invention.

One or more of the above objects can basically be attained by providing a turbo economizer adapted to be used in a chiller system including a compressor, an evaporator, and a condenser connected to form a refrigeration circuit, the turbo economizer including a nozzle configured and arranged to introduce refrigerant into the turbo economizer, a turbine disposed downstream of the nozzle, the turbine being attached to a shaft rotatable about a rotation axis and a flow of the refrigerant introduced through the nozzle driving the turbine to rotate the shaft, and an economizer impeller attached to the shaft so as to be rotated in accordance with rotation of the shaft. In the turbo economizer, the nozzle is further configured and arranged to reduce a pressure of the refrigerant such that a pressure of the refrigerant entering the turbo economizer is lower than a predetermined pressure, at least some of the refrigerant passes through the nozzle being introduced into the economizer impeller, and the economizer impeller is configured and arranged to increase a pressure of the refrigerant introduced there into to the predetermined pressure.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF EMBODIMENT(S)

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
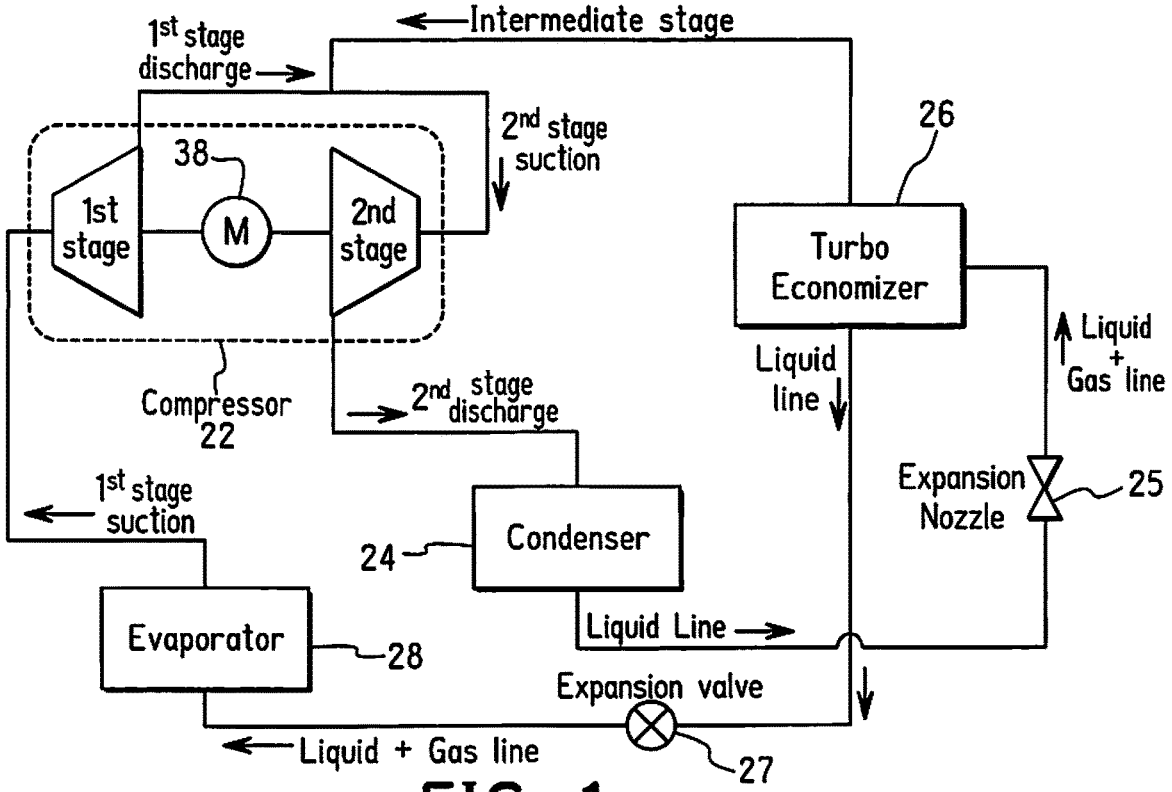
FIG. 1 illustrates a chiller system which includes a turbo economizer in accordance with a first embodiment of the present invention.

Referring initially to FIG. 1, a chiller system 10, which includes a turbo economizer 26 in accordance with a first embodiment of the present invention, is illustrated. The chiller system 10 is preferably a water chiller that utilizes cooling water and chiller water in a conventional manner. The chiller system 10 illustrated herein is a two-stage chiller system. However, it will be apparent to those skilled in the art from this disclosure that the chiller system 10 could be a multiple stage chiller system including more stages as long as it has an intermediate stage.

The chiller system 10 basically includes a compressor 22, a condenser 24, an expansion nozzle 25, a turbo economizer 26, an expansion valve 27, and an evaporator 28 connected together in series to form a refrigeration circuit. In addition, various sensors (not shown) are disposed throughout the circuit of the chiller system 10.

Figure 2:
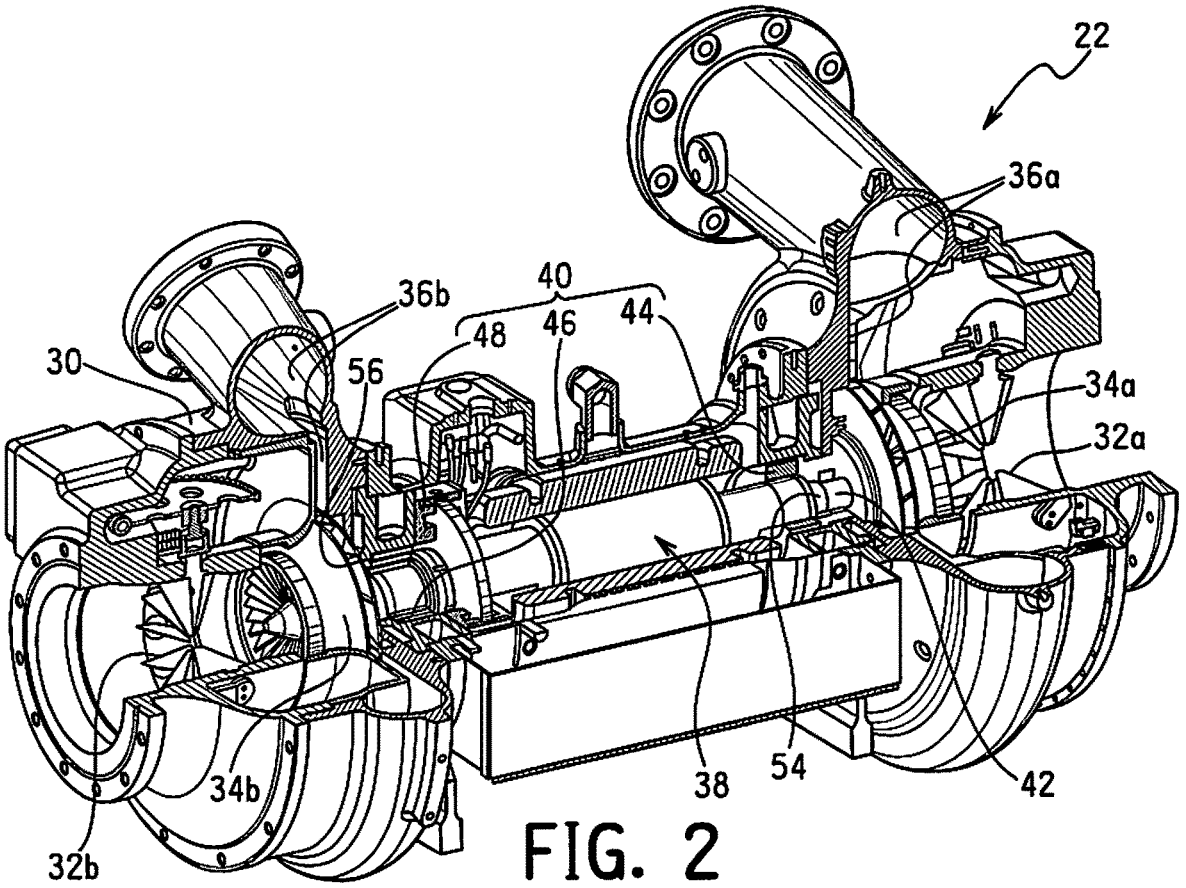
FIG. 2 is a perspective view of the centrifugal compressor of the chiller system illustrated in FIG. 1, with portions broken away and shown in cross-section for the purpose of illustration.

Referring to FIGS. 1 and 2, the compressor 22 is a two-stage centrifugal compressor in the illustrated embodiment. More specifically, the compressor 22 illustrated herein is a two-stage centrifugal compressor which includes two impellers. However, the compressor 22 can be a multiple stage centrifugal compressor including more impellers. The two-stage centrifugal compressor 22 of the illustrated embodiment includes a first stage impeller 34*a* and a second stage impeller 34*b*. The centrifugal compressor 22 further includes a first stage inlet guide vane 32*a*, a first diffuser/volute 36*a*, a second stage inlet guide vane 32*b*, a second diffuser/volute 36*b*, a compressor motor 38, and a magnetic bearing assembly 40 as well as various conventional sensors (not shown).

Refrigerant flows in order through the first stage inlet guide vane 32*a*, the first stage impeller 34*a*, the second stage inlet guide vane 32*b*, and the second stage impeller 34*b*. The inlet guide vanes 32*a* and 32*b* control the flow rate of refrigerant gas into the impellers 34*a* and 34*b*, respectively, in a conventional manner. The impellers 34*a* and 34*b* increase the velocity of refrigerant gas, generally without changing pressure. The motor speed determines the amount of increase of the velocity of refrigerant gas. The diffusers/volutes 36*a* and 36*b* increase the refrigerant pressure. The diffusers/volutes 36*a* and 36*b* are non-movably fixed relative to a compressor casing 30. The compressor motor 38 rotates the impellers 34*a* and 34*b* via a shaft 42. The magnetic bearing assembly 40 magnetically supports the shaft 42. The magnetic bearing assembly 40 preferably includes a first radial magnetic bearing 44, a second radial magnetic bearing 46 and an axial (thrust) magnetic bearing 48. In any case, at least one radial magnetic bearing 44 or 46 rotatably supports the shaft 42. The thrust magnetic bearing 48 supports the shaft 42 along a rotational axis. Alternatively, the bearing system may include a roller element, a hydrodynamic bearing, a hydrostatic bearing, and/or a magnetic bearing, or any combination of these. In this manner, the refrigerant is compressed in the centrifugal compressor 22.

In operation of the chiller system 10, the first stage impeller 34*a* and the second stage impeller 34*b* of the compressor 22 are rotated, and the refrigerant of low pressure in the chiller system 10 is sucked by the first stage impeller 34*a*. The flow rate of the refrigerant is adjusted by the inlet guide vane 32*a*. The refrigerant sucked by the first stage impeller 34*a* is compressed to intermediate pressure, the refrigerant pressure is increased by the first diffuser/volute 36*a*, and the refrigerant is then introduced to the second stage impeller 34*b*. The flow rate of the refrigerant is adjusted by the inlet guide vane 32*b*. The second stage impeller 34*b* compresses the refrigerant of intermediate pressure to high pressure, and the refrigerant pressure is increased by the second diffuser/volute 36*b*. The high pressure gas refrigerant is then discharged to the chiller system 10.

As mentioned above, the chiller system 10 has the turbo economizer 26 in accordance with the present invention. The chiller system 10 is conventional, except for the turbo economizer 26 in accordance with the present invention. Therefore, the chiller system 10 will not be discussed and/or illustrated in further detail herein except as related to the turbo economizer 26. However, it will be apparent to those skilled in the art that the conventional parts of the chiller system 10 can be constructed in variety of ways without departing the scope of the present invention.

The turbo economizer 26 is connected to an intermediate stage of the compressor 22 to inject gas refrigerant into the intermediate stage of the compressor 22, as explained in more detail below. In the illustrated embodiments, the turbo economizer 26 is disposed between the evaporator 28 and the condenser 24 in the chiller system 10.

Figure 3A:
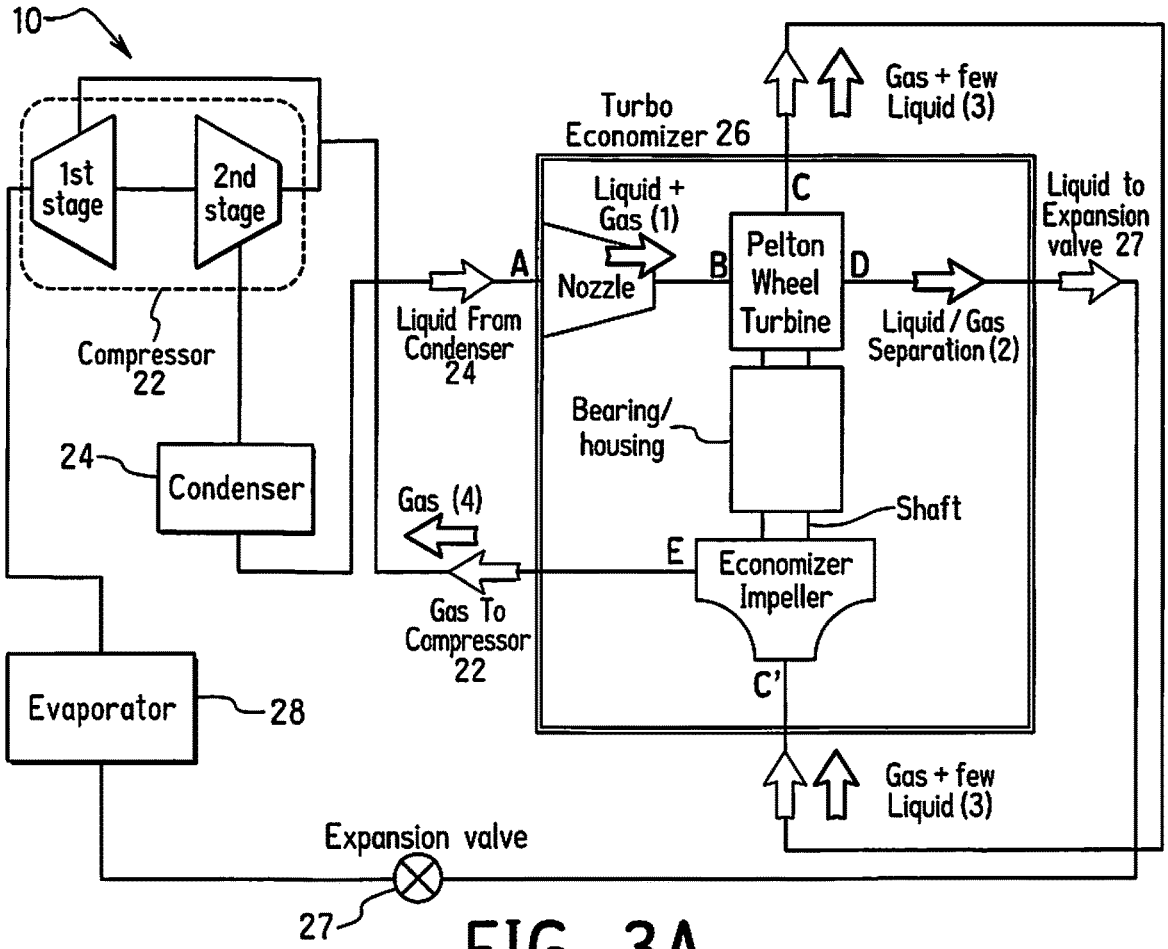
FIG. 3A is a schematic view of the turbo economizer in the chiller system illustrated in FIG. 1.
Figure 6:
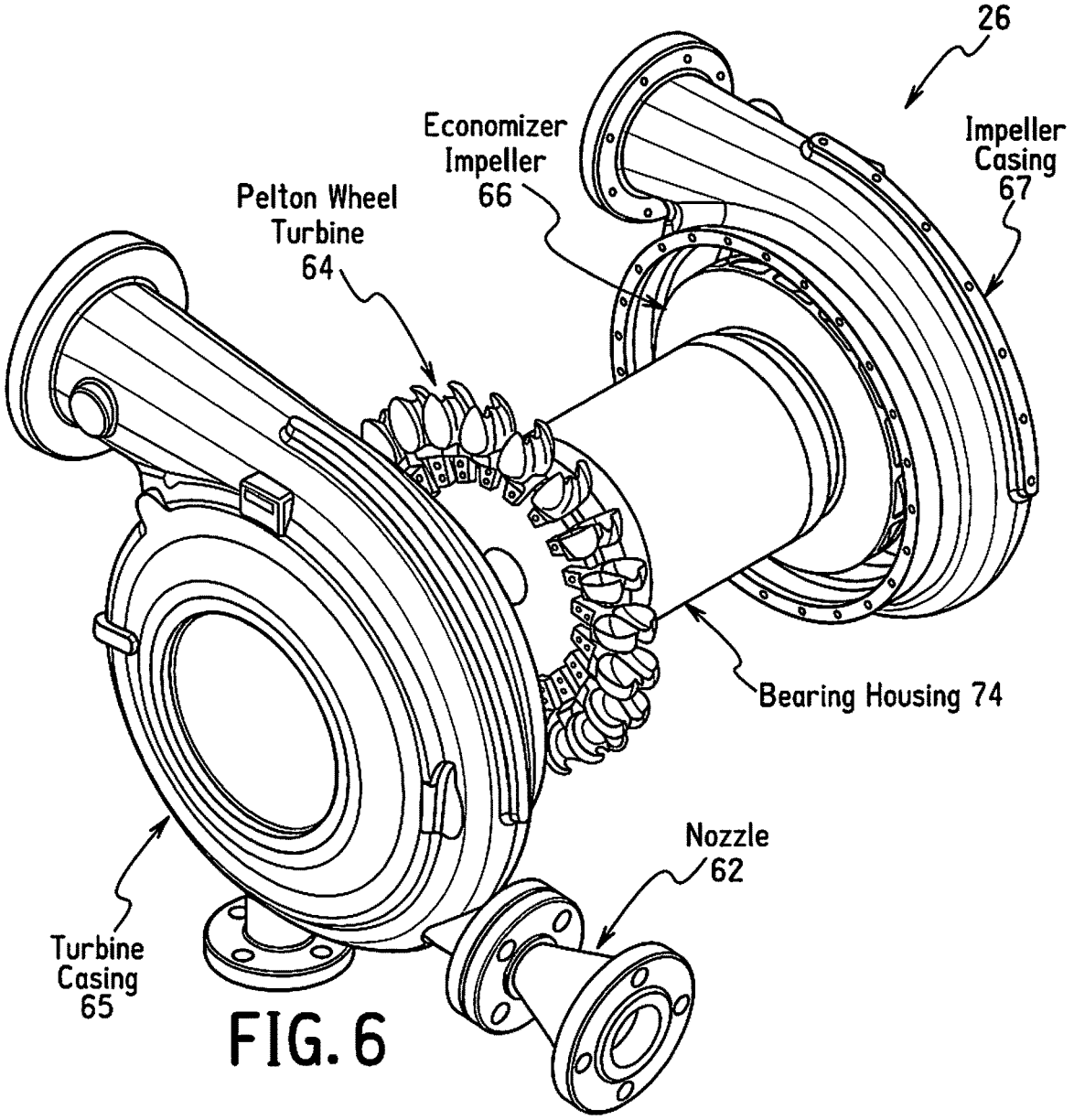
FIG. 6 is an exploded perspective view of the turbo economizer illustrated in FIG. 5.

Referring to FIGS. 3A and 6, the turbo economizer 26 basically includes a nozzle 62, a Pelton wheel turbine 64, and an economizer impeller 66. The Pelton wheel turbine 64 is disposed inside a turbine casing 65. The economizer impeller 66 is disposed inside an impeller casing 67. The turbo economizer 26 further includes a tubular casing (not shown) which connects the turbine casing 65 and the impeller casing 67. One end of the tubular casing is attached to the turbine casing 65 and the other end of the tubular casing is attached to the impeller casing 67. The turbine casing 65 includes a gas outlet 65C and a liquid outlet 65D.

Figure 7:
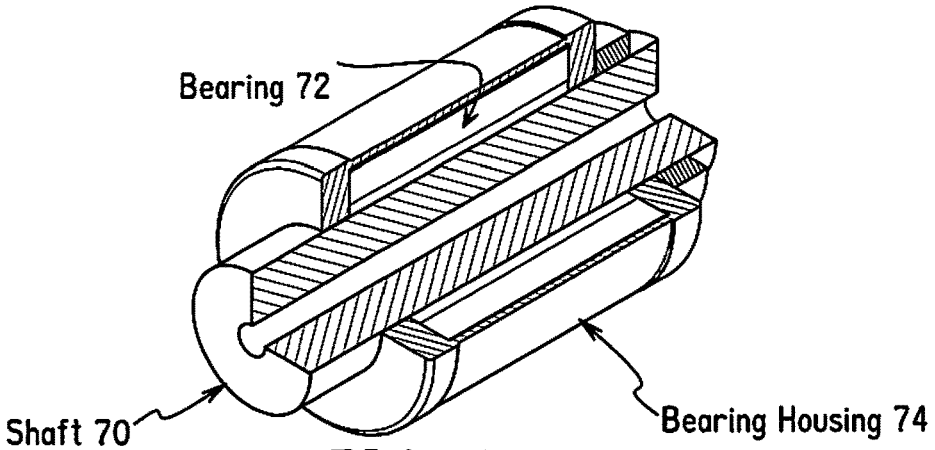
FIG. 7 is a perspective view of the bearing housing of the turbo economizer illustrated in FIGS. 5 and 6, with portions broken away and shown in cross-section for the purpose of illustration.

Referring to FIGS. 3A, 5, 6 and 7, the turbo economizer 26 further includes a shaft 70, a bearing 72, and a bearing housing 74. The shaft 70 is rotatable about a rotation axis extending along a longitudinal direction of the shaft 70. The bearing 72 is disposed inside the bearing housing 74. The bearing 72 is fixed and supports the shaft 70 in a rotatable manner. The bearing 72 is conventional, and thus, will not be discussed and/or illustrated in detail herein, except as related to the present invention. Rather, it will be apparent to those skilled in the art that any suitable bearing can be used without departing from the present invention. Examples of the bearing 72 include a roller bearing, a slide bearing, and/or a magnetic bearing. The bearing 72 illustrated in FIG. 7 is a slide bearing.

The nozzle 62 is disposed at the entrance of the turbo economizer 26 to introduce refrigerant leaving the condenser 24 into the turbo economizer 26. The Pelton wheel turbine 64 is disposed downstream of the nozzle 62. The Pelton wheel turbine 64 is attached to one end of the shaft 70. The economizer impeller 66 is attached to the other end of the shaft 70. The flow of refrigerant in the chiller system 10 enters the turbo economizer 26 from the nozzle 62 and goes to the Pelton wheel turbine 64. The refrigerant flow then drives the Pelton wheel turbine 64 and rotates the shaft 70 attached to the Pelton wheel turbine 64. The economizer impeller 66 is then rotated in accordance with rotation of the shaft 70. Namely, in the turbo economizer 26, the motive power generated by the Pelton wheel turbine 64 using the flow of the refrigerant is transmitted through the shaft 70, and the transmitted motive power drives the economizer impeller 66. In this manner, the turbo economizer 26 is refrigerant-powered without using a separate motor. More specifically, the turbo economizer 26 in accordance with the present invention does not need a motor such as an electric motor to drive the Pelton wheel turbine 64 or the economizer impeller 66.

Figure 5:
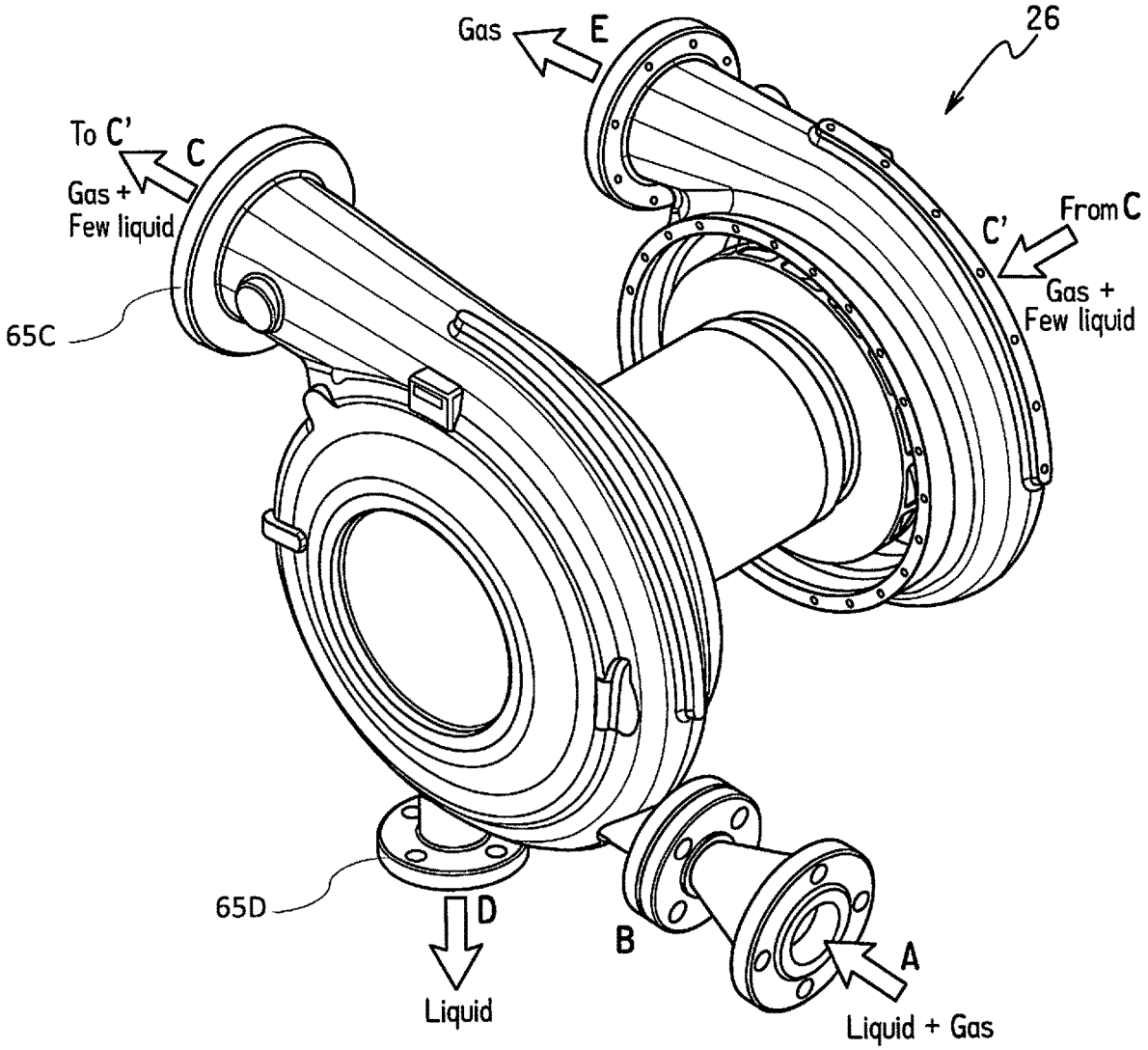
FIG. 5 is a perspective view of the turbo economizer illustrated in FIG. 3A showing the flow of refrigerant.

While the refrigerant passes therethrough, the nozzle 62 reduces the pressure of the refrigerant and increases the flow velocity of the refrigerant. More specifically, with the nozzle 26, the pressure of the refrigerant entering the turbo economizer 26 is reduced to be lower than the intermediate pressure of the refrigerant in the intermediate stage of the compressor 22. The intermediate stage of the compressor 22 is located between the first stage and the second stage of the compressor 22. The refrigerant passing through the nozzle 62 is two-phase (gas-liquid) refrigerant. The refrigerant is then introduced into the Pelton wheel turbine 64. The Pelton wheel turbine 64 separates the two-phase refrigerant into gas refrigerant and liquid refrigerant. The gas refrigerant is discharged via the gas outlet 65C and the liquid refrigerant is discharged via the liquid outlet 65D as shown in FIG. 5. The Pelton wheel turbine 64 also reduces the flow velocity of the refrigerant.

The liquid refrigerant separated in the Pelton wheel turbine 64 is introduced into the expansion valve 27 in the chiller system 10. On the other hand, the refrigerant, mainly including gas refrigerant and few liquid refrigerant, separated in the Pelton wheel turbine 64 is introduced into the economizer impeller 66 via a pipe (not shown) connecting the Pelton wheel turbine 64 and the economizer impeller 66. The economizer impeller 66 increases the pressure of the refrigerant introduced thereinto to the intermediate pressure. As mentioned above, the economizer impeller 66 is driven by the motive power from the Pelton wheel turbine 64.

The refrigerant leaving the economizer impeller 66 is injected into the intermediate stage of the compressor 22. The gas refrigerant injected into the intermediate stage of the compressor 22 is then mixed with the refrigerant of intermediate pressure compressed by the first stage impeller 34*a* of the compressor 22. The mixed refrigerant flows to the second stage impeller 34*b* to be further compressed.

Figure 3B:
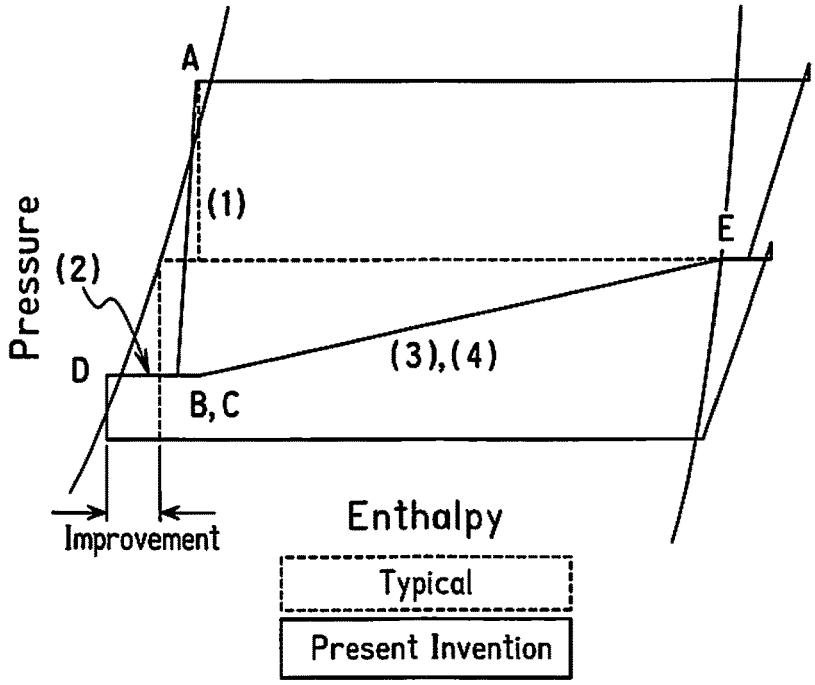
FIG. 3B is a p-h diagram showing the pressure of refrigerant at each point in the turbo economizer.

Referring to FIGS. 3A, 3B, and 5, the flow of the refrigerant in the turbo economizer 26 and the pressure of the refrigerant at each position of the turbo economizer 26 will now be explained. The refrigerant leaving the condenser 24 enters the turbo economizer 26 through the nozzle 62 (position A). The pressure of the refrigerant is reduced to be lower than the intermediate pressure by the nozzle 62. See process (1) in FIGS. 3A and 3B. The flow of the refrigerant passing through the nozzle 62 is introduced into the Pelton wheel turbine 64 (position B). The refrigerant is separated into gas refrigerant and liquid refrigerant in the Pelton wheel turbine 64. The liquid refrigerant separated in the Pelton wheel turbine 64 leaves the Pelton wheel turbine 64 (position D), and flows to the expansion valve 27 in the chiller system 10. See process (2) in FIGS. 3A and 3B. On the other hand, the gas refrigerant separated in the Pelton wheel turbine 64 leaves the Pelton wheel turbine 64 (position C), and flows to the economizer impeller 66 (position C'). The pressure of the gas refrigerant is increased up to the intermediate pressure by the economizer impeller 66. The gas refrigerant of the intermediate pressure leaves the economizer impeller 66 (position E) to be injected into the intermediate stage of the compressor 22. See processes (3) and (4) in FIGS. 3A and 3B.

In this manner, the pressure of the refrigerant in the turbo economizer 26 is reduced to be lower than the intermediate pressure of the compressor 22 by the nozzle 62. Also, work is extracted from process (1) of expanding the refrigerant (from position A to position B), and the extracted work is imparted to the economizer impeller 66. In accordance with the present invention, $\Delta h$ is increased as shown in the p-h diagram of FIG. 3B. As a result, the improvement of the cooling capacity in the chiller system 10 can be achieved.

Figure 4A:
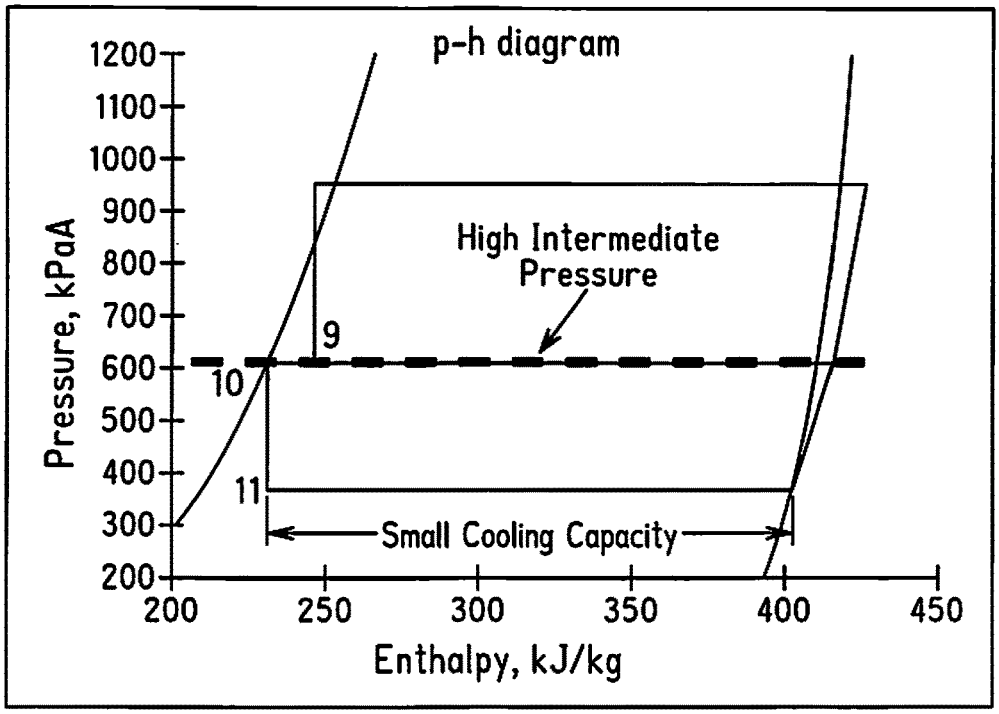
FIG. 4A is a p-h diagram of a typical cycle.
Figure 4B:
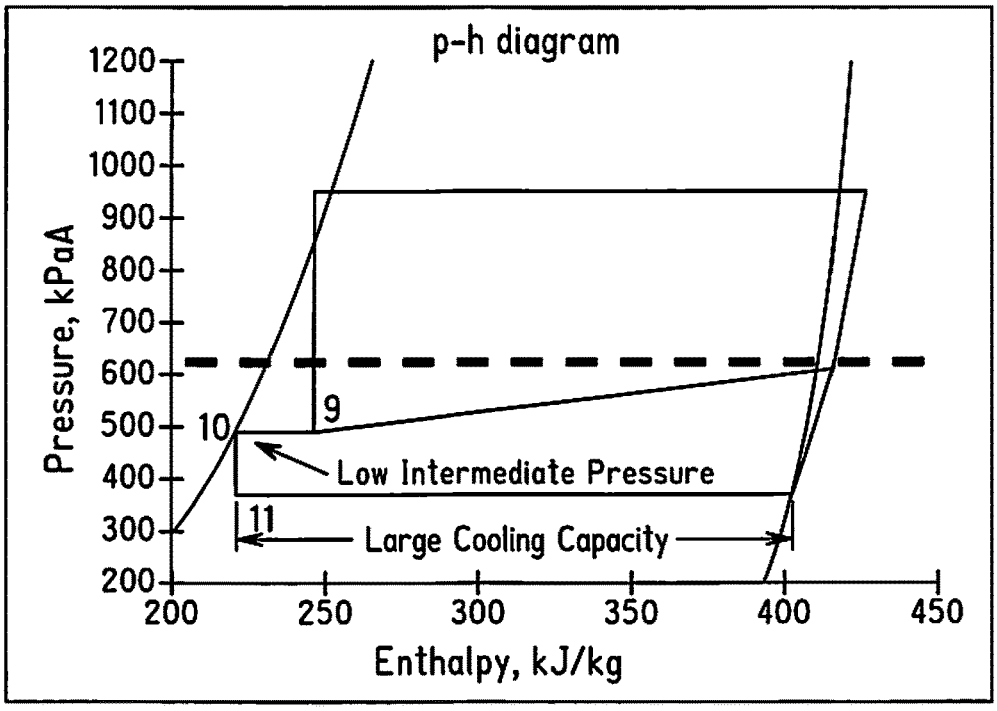
FIG. 4B is a p-h diagram of an improved cycle in the turbo economizer illustrated in FIG. 3A.

Referring to FIGS. 4A and 4B, an example of engineering values of the cooling capacity improvement will be explained. FIG. 4A is a p-h diagram of a typical cycle, and FIG. 4B is a p-h diagram of an improved cycle using the turbo economizer 26 in accordance with the present invention. The engineering values explained here are merely examples using R134a as refrigerant. It will be apparent to those skilled in the art that the engineering data and the diagrams are different depending on the refrigerant type and the operating conditions. In these examples, the intermediate pressures for the typical cycle is 612 kPa as shown in FIG. 4A, and the intermediate pressure for the improved cycle in accordance with the present invention is 490 kPa as shown in FIG. 4B. Accordingly, the intermediate pressure is reduced by 122 kPa. The cooling capacity (the enthalpy difference at the evaporator) for the typical cycle is 172 kJ/kg, and the cooling capacity for the improved cycle in accordance with the present invention is 182 kJ/kg. Accordingly, the cooling capacity is increased by 10 kJ/kg. The theoretical COP (coefficient of performance) for the typical cycle is 8.21, and the theoretical COP for the improved cycle in accordance with the present invention is 8.69. Accordingly, the theoretical COP is increased approximately by 5%. In this manner, the COP will be improved by using the turbo economizer 26 in accordance with the present invention.

Second Embodiment

Figure 8A:
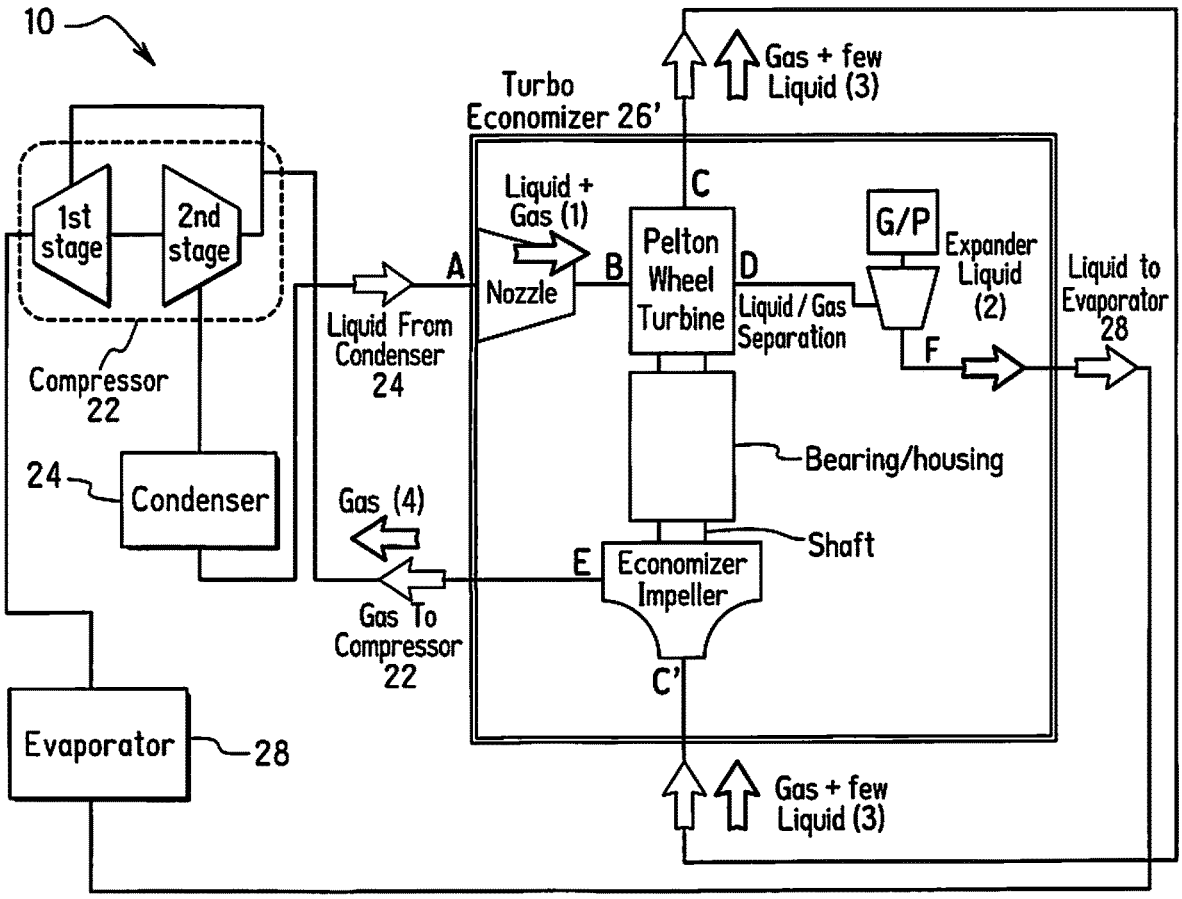
FIG. 8A is a schematic view of the turbo economizer (with an expander) in accordance with a second embodiment of the present invention in the chiller system.

Referring to FIG. 8A, the turbo economizer 26' in accordance with a second embodiment of the present invention will be explained. In this embodiment, the turbo economizer 26' further includes an expander 68. The other elements of the turbo economizer 26' in accordance with the second embodiment are substantially identical to those of the turbo economizer 26 in accordance with the first embodiment. Therefore, they will not be discussed in detail herein, except as needed to understand the second embodiment. The descriptions and illustrations of the first embodiment apply to the second embodiment except as explained and/or illustrated herein.

As mentioned above, the turbo economizer 26' in accordance with the second embodiment includes the expander 68. The expander 68 is disposed downstream of the Pelton wheel turbine 64. The expander 68 includes at least one expander impeller. The expander 68 performs an expansion process on the refrigerant introduced from the Pelton wheel turbine 64 into the expander 68. The refrigerant which has undergone the expansion process in the expander 68 is introduced into the evaporator 28 in the chiller system 10. The chiller system 10, which uses the turbo economizer 26' in accordance with the second embodiment, does not require the expansion valve 27.

Figure 8B:
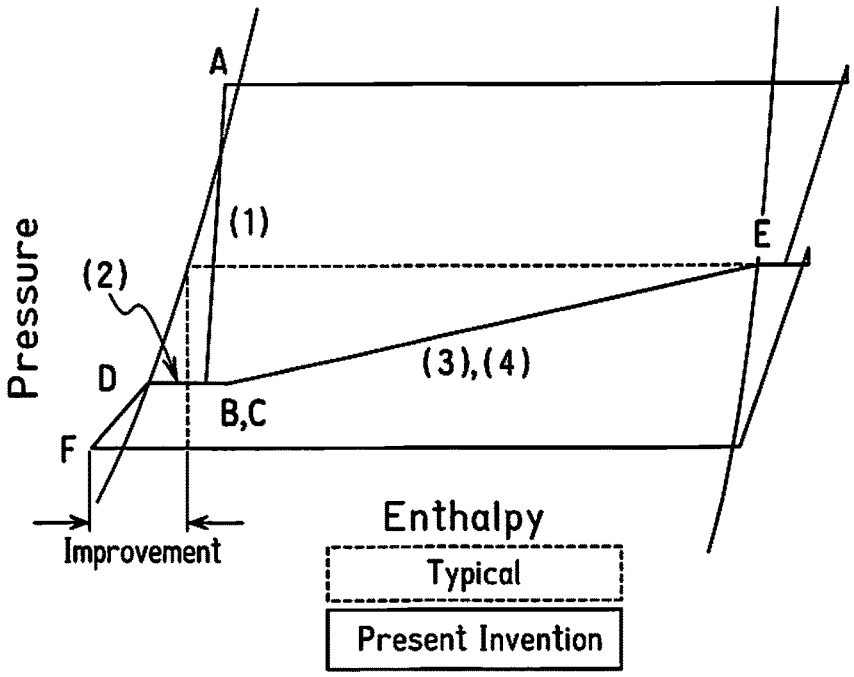
FIG. 8B is a p-h diagram showing the pressure of refrigerant at each point in the turbo economizer in accordance with the second embodiment of the present invention.
Figure 11:
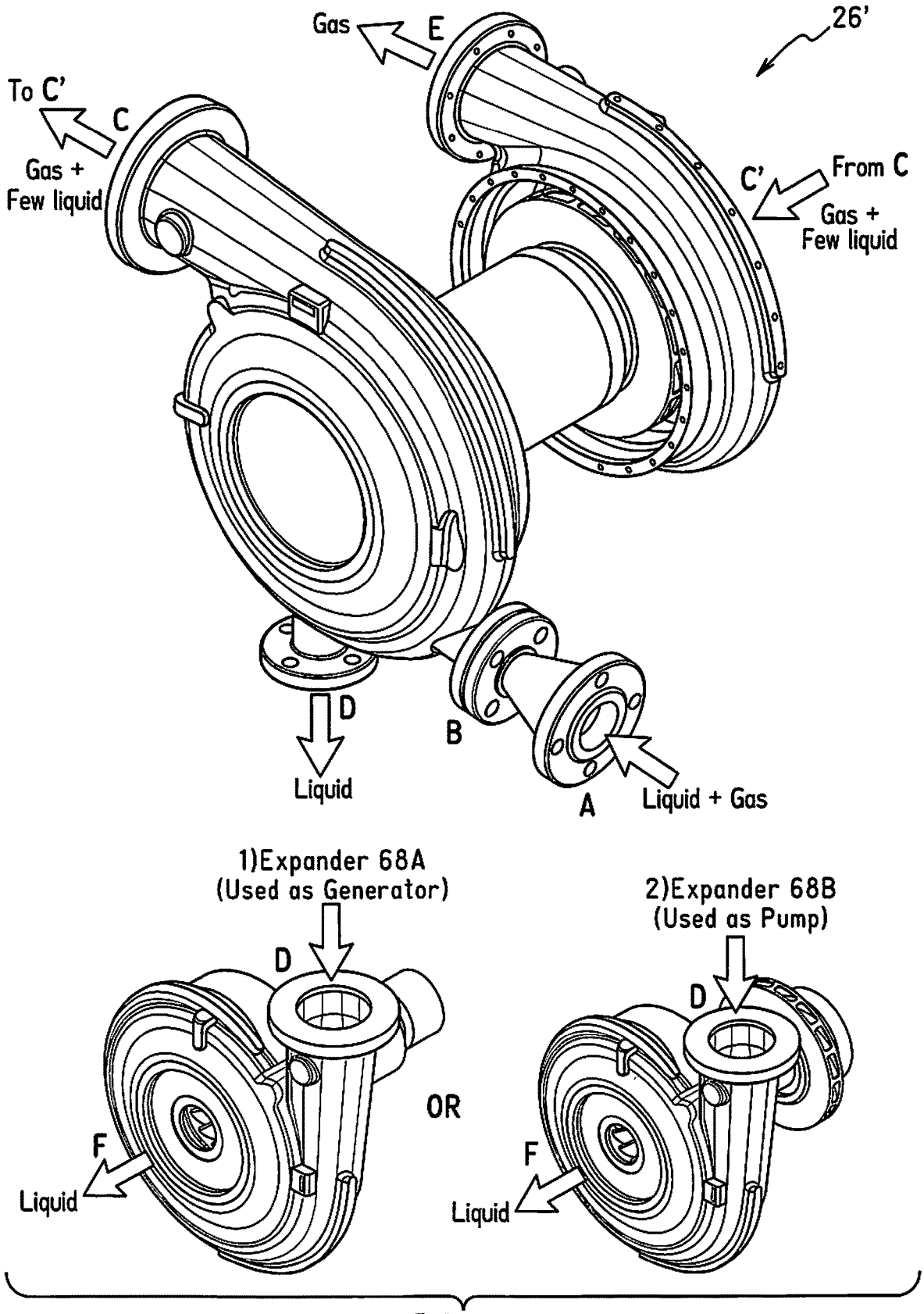
FIG. 11 is perspective views of the turbo economizer and the expander in accordance with the second embodiment of the present invention showing the flow of refrigerant.

Referring to FIGS. 8A, 8B, and 11, the flow of the refrigerant in the turbo economizer 26', and the pressure of the refrigerant at each position of the turbo economizer 26' will now be explained. The refrigerant leaving the condenser 24 enters the turbo economizer 26 through the nozzle 62 (position A). The pressure of the refrigerant is reduced to be lower than the intermediate pressure by the nozzle 62. See process (1) in FIGS. 8A and 8B. The flow of the refrigerant passing through the nozzle 62 is introduced into the Pelton wheel turbine 64 (position B). The refrigerant is separated into gas refrigerant and liquid refrigerant in the Pelton wheel turbine 64. The gas refrigerant separated in the Pelton wheel turbine 64 leaves the Pelton wheel turbine 64 (position C), and flows to the economizer impeller 66 (position C'). The pressure of the gas refrigerant is increased up to the intermediate pressure by the economizer impeller 66. The gas refrigerant of the intermediate pressure leaves the economizer impeller 66 (position E) to be injected into the intermediate stage of the compressor 22. See processes (3) and (4) in FIGS. 8A and 8B. On the other hand, the liquid refrigerant separated in the Pelton wheel turbine 64 leaves the Pelton wheel turbine 64 (position D), and flows to the expander 68 including an expander 68A and an expander 68B explained below. The refrigerant undergoes an expansion process in the expander 68. The refrigerant leaving the expander 68 (position F) is introduced into the evaporator 28 in the chiller system 10. See process (2) in FIGS. 8A and 8B.

In this manner, the pressure of the refrigerant in the turbo economizer 26' is reduced to be lower than the intermediate pressure of the compressor 22. Also, work is extracted from process (1) of expanding the refrigerant (from position A to position B), and the extracted work is imparted to the economizer impeller 66. In the turbo economizer 26' in accordance with the second embodiment, additional work is extracted from the expansion process in the expander 68 (from position D to position F). As a result, further improvement of the cooling capacity in the chiller system 10 can be achieved as shown in FIG. 8B.

Figure 9A:
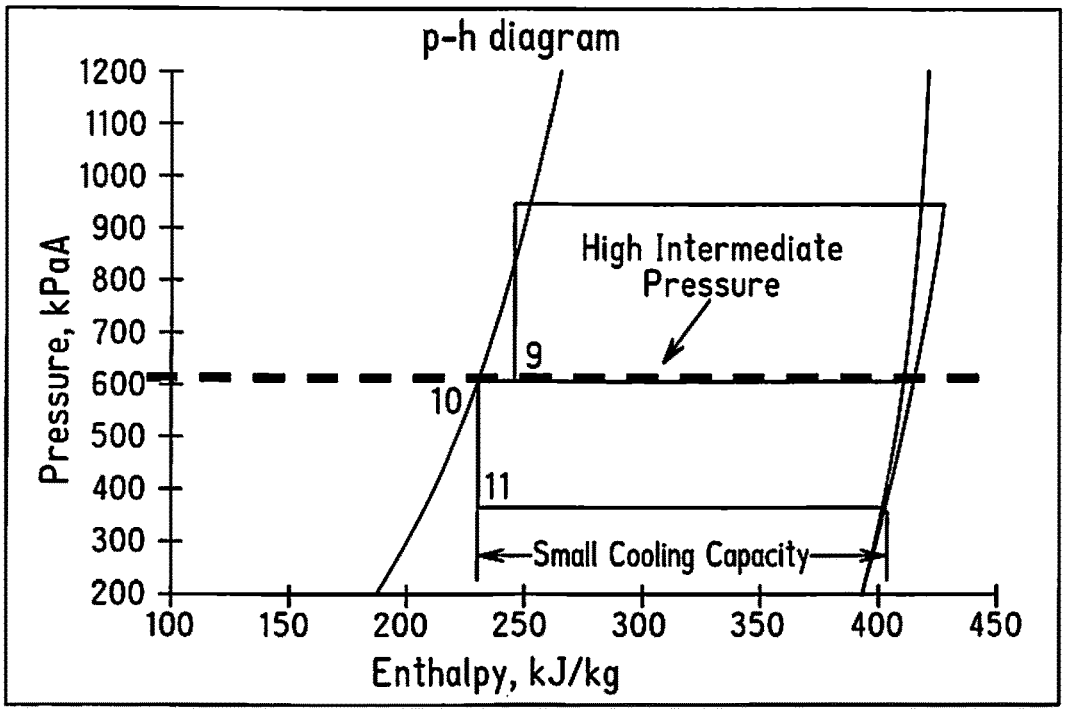
FIG. 9A is a p-h diagram of a typical cycle.
Figure 9B:
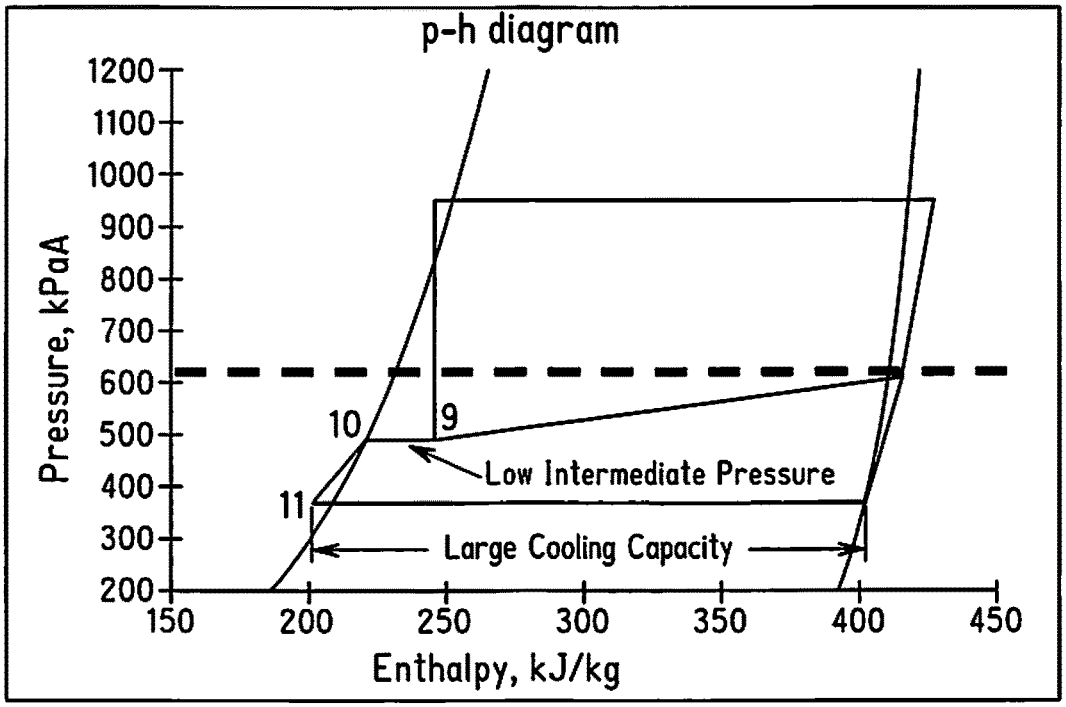
FIG. 9B is a p-h diagram of an improved cycle in the turbo economizer in accordance with the second embodiment of the present invention illustrated in FIG. 8A.

Referring to FIGS. 9A and 9B, an example of engineering values of the cooling capacity improvement will be explained. FIG. 9A is a p-h diagram of a typical cycle, and FIG. 9B is a p-h diagram of an improved cycle using the turbo economizer 26' in accordance with the second embodiment of the present invention. The engineering values explained here are merely examples using R134a as refrigerant. It will be apparent to those skilled in the art that the engineering data and the diagrams are different depending on the refrigerant type and the operating conditions. In these examples, the intermediate pressures for the typical cycle is 612 kPa as shown in FIG. 9A, and the intermediate pressure for the improved cycle in accordance with the second embodiment of the present invention is 490 kPa as shown in FIG. 9B. Accordingly, the intermediate pressure is reduced by 122 kPa. The cooling capacity (the enthalpy difference at the evaporator) for the typical cycle is 172 kJ/kg, and the cooling capacity for the improved cycle in accordance with the second embodiment of the present invention is 201 kJ/kg. Accordingly, the cooling capacity is increased by 29 kJ/kg. The theoretical COP (coefficient of performance) for the typical cycle is 8.21, and the theoretical COP for the improved cycle in accordance with the second embodiment of the present invention is 9.60. Accordingly, the theoretical COP is increased approximately by 17%. In this manner, the COP will be further improved by using the turbo economizer 26' in accordance with the second embodiment of the present invention.

Figure 10A:
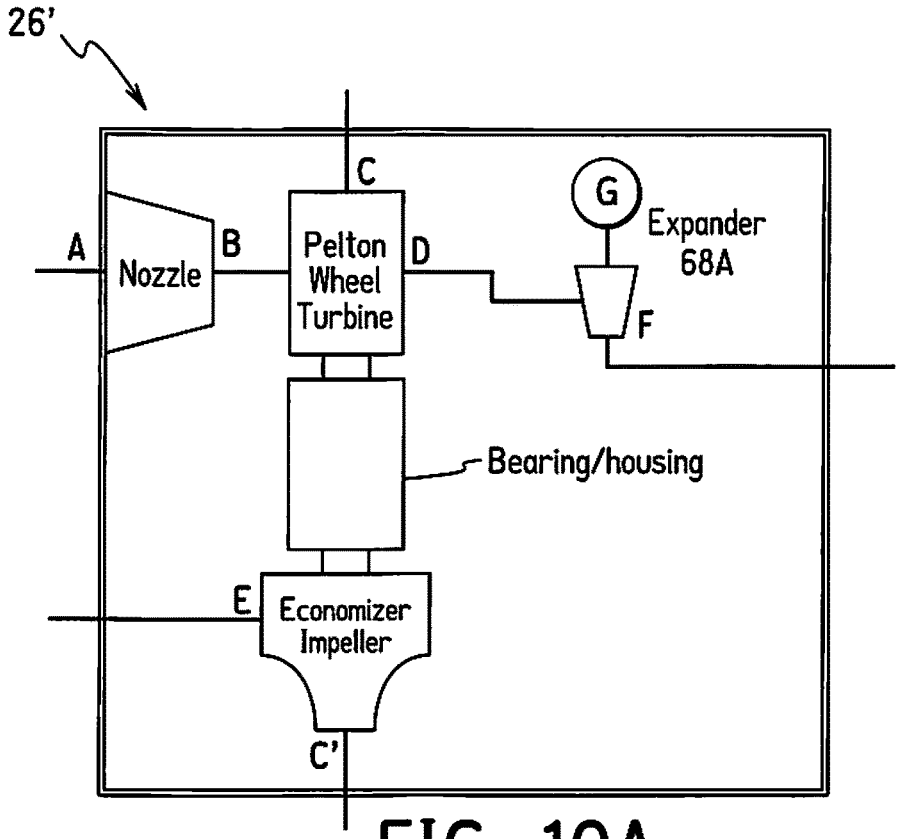
FIG. 10A is a schematic view of the turbo economizer in accordance with the second embodiment of the present invention in which the expander is used as a power generator.
Figure 10B:
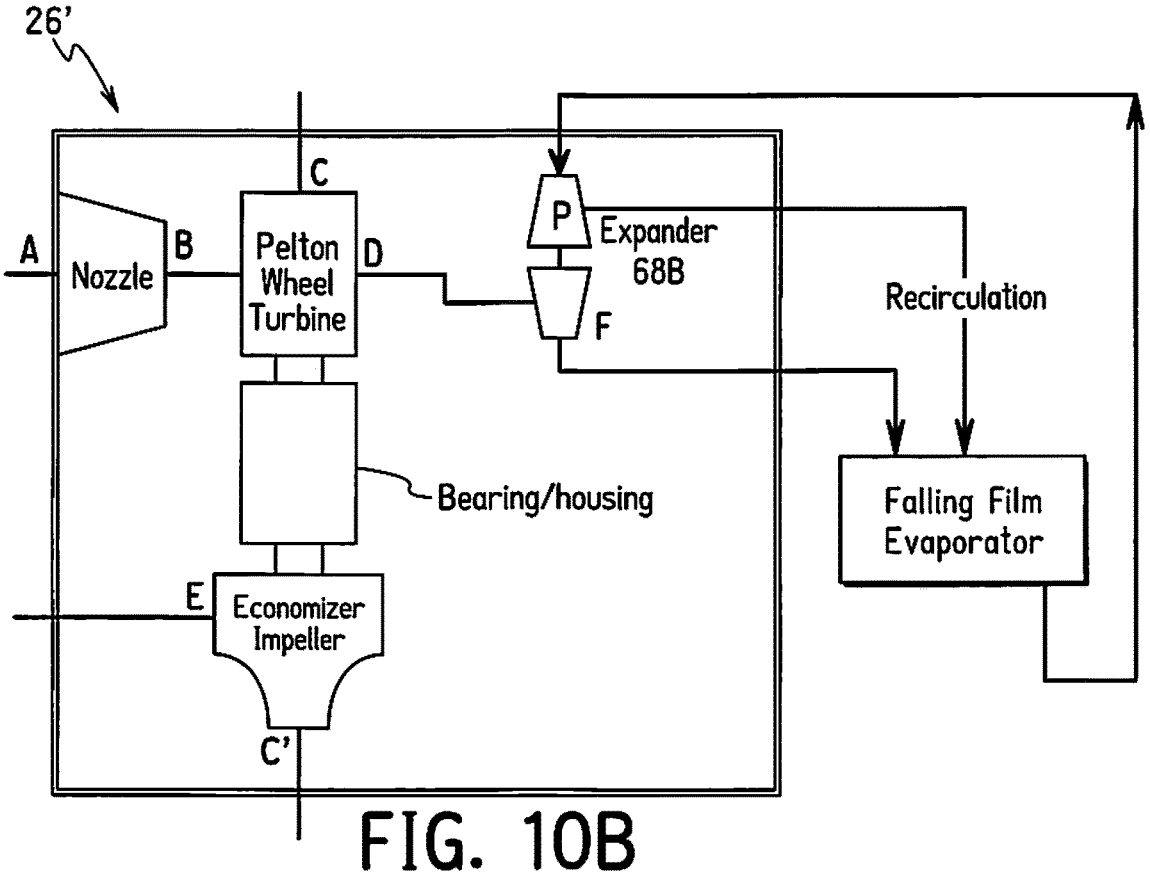
FIG. 10B is a schematic view of the turbo economizer in accordance with the second embodiment of the present invention in which the expander is used as a pump.

As illustrated in FIGS. 10A and 10B, the expander 68 of the turbo economizer 26' in accordance with the second embodiment of the present invention can be used as a power generator or a pump. In the case of the expander 68A used as a power generator (FIG. 10A), the rotational energy in the expander 68A is utilized to obtain electric energy in the power generator. In the case of the expander 68B used as a pump (FIG. 10B), the expander 68B serves as a pump to recirculate the refrigerant through a falling film evaporator as explained in more detail below.

Figure 12A:
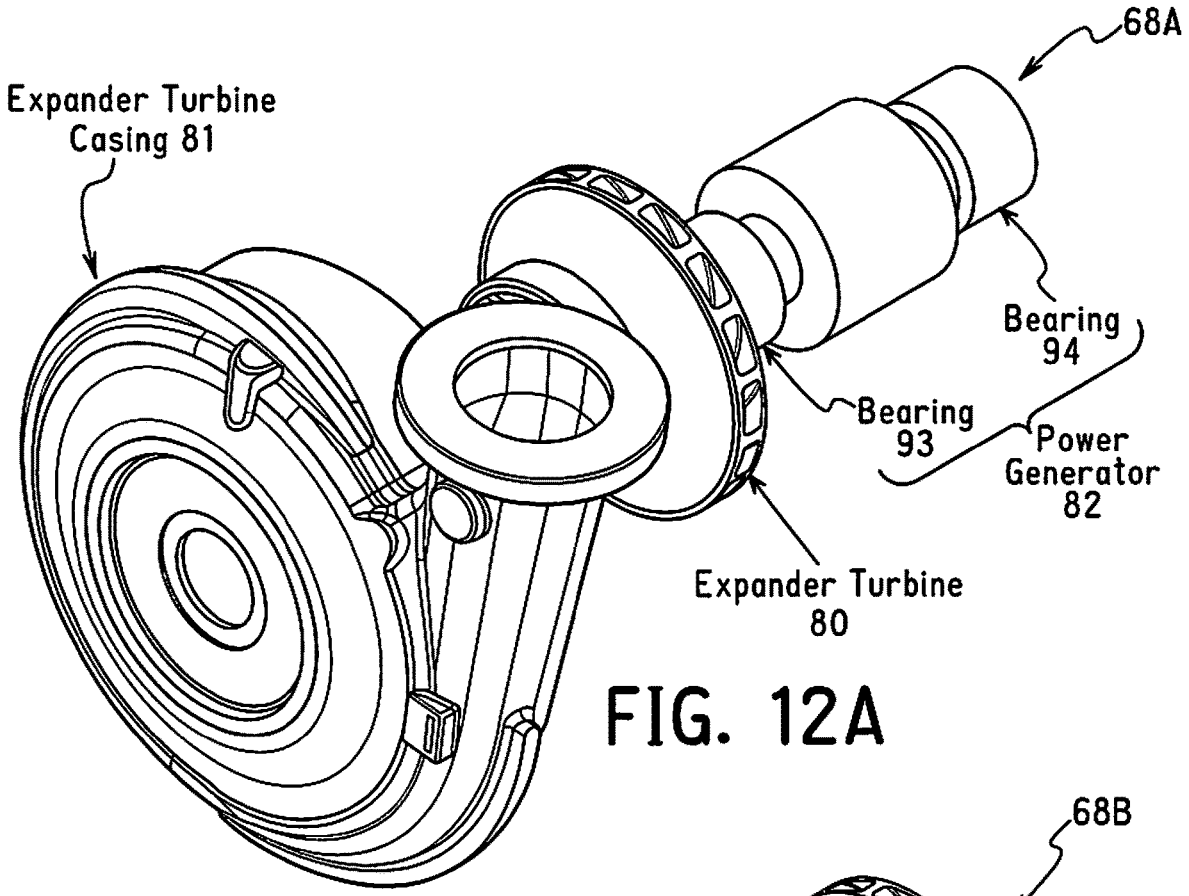
FIG. 12A is an exploded perspective view of the expander used as a power generator illustrated in FIG. 10A.
Figure 12B:
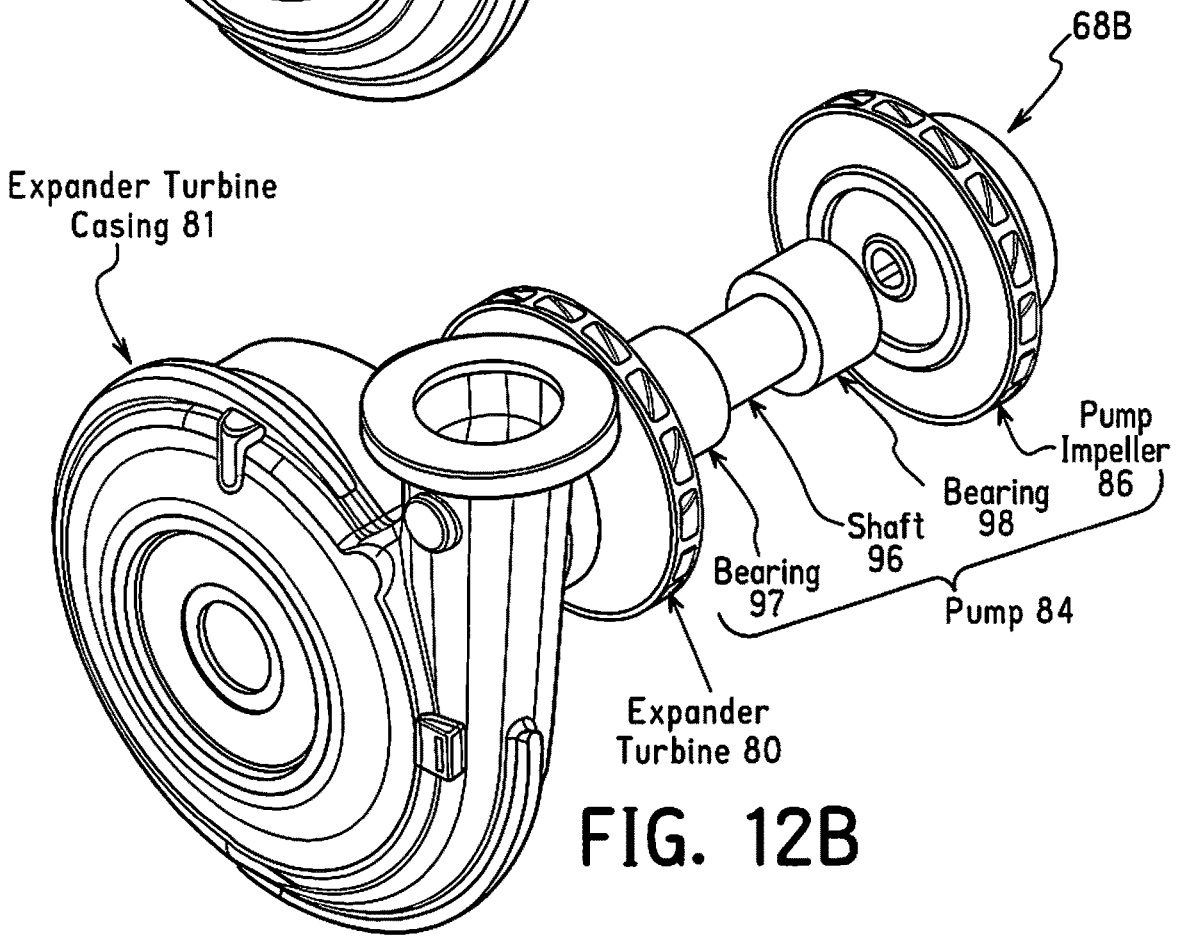
FIG. 12B is an exploded perspective view of the expander used as a pump illustrated in FIG. 10B.

FIG. 12A is an exploded perspective view of the expander 68A used as a power generator illustrated in FIG. 10A. FIG. 12B is an exploded perspective view of the expander 68B used as a pump illustrated in FIG. 10B. Also, FIG. 13A is a schematic cross-sectional view of the expander 68A, and FIG. 13B is a schematic cross-sectional view of the expander 68B.

Figure 13A:
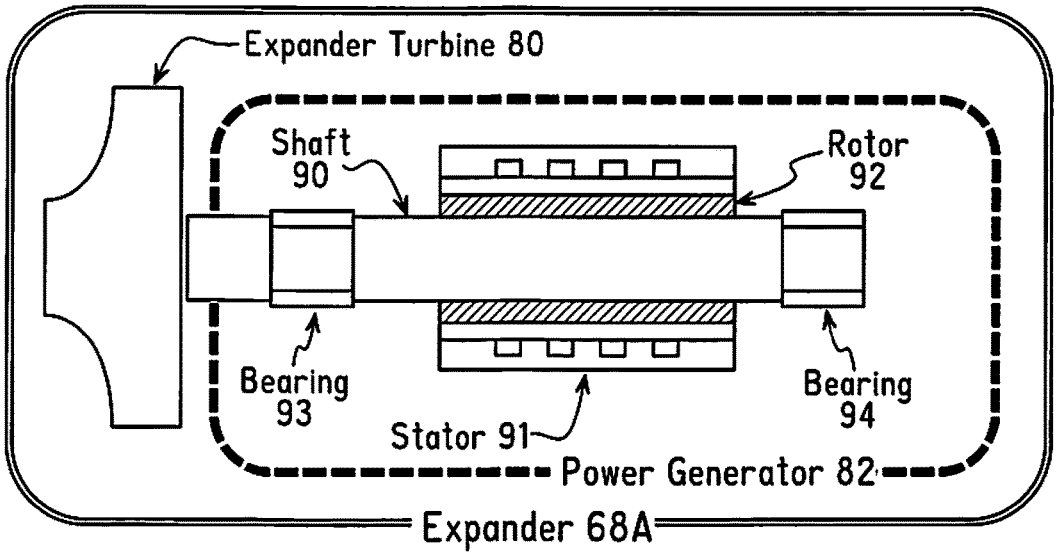
FIG. 13A is a schematic cross-sectional view of the expander used as a power generator illustrated in FIG. 10A.

Referring to FIGS. 12A and 13A, the expander 68A basically includes an expander turbine 80 and a power generator 82. The expander turbine 80 is disposed inside an expander turbine casing 81. The power generator 82 is disposed inside a power generator casing (not shown). The expander 68A further includes a casing (not shown) which connects the expander turbine casing 81 and the power generator casing. The power generator 82 includes a shaft 90, a stator 91, and a rotor 92. The shaft 90 is rotatable about a rotation axis extending along a longitudinal direction of the shaft 90. The shaft 90 is attached to the expander turbine 80 at one end thereof. The stator 91 is a stationary member, which is fixed to the power generator casing, for example. The rotor 92 is disposed inside the stator 91, and is fixedly coupled to the shaft 90. A bearing 93 and a bearing 94 are disposed to rotatably support the shaft 90. The bearings 93 and 94 are conventional, and thus, will not be discussed and/or illustrated in detail herein. It will be apparent to those skilled in the art that any suitable bearing can be used without departing from the present invention.

In operation, the expander turbine 80 is rotated by work imparted from the refrigerant, and the rotational energy is converted into electric energy. In this manner, the expander 68A is used as a power generator driven by energy obtained in the expansion process of the refrigerant. The generated electric power can be used as a power source for driving the inlet guide vane, the magnetic bearing, or electronic expansion mechanism in the chiller system 10. Also, a storage battery can be provided to store the generated electric power.

Figure 13B:
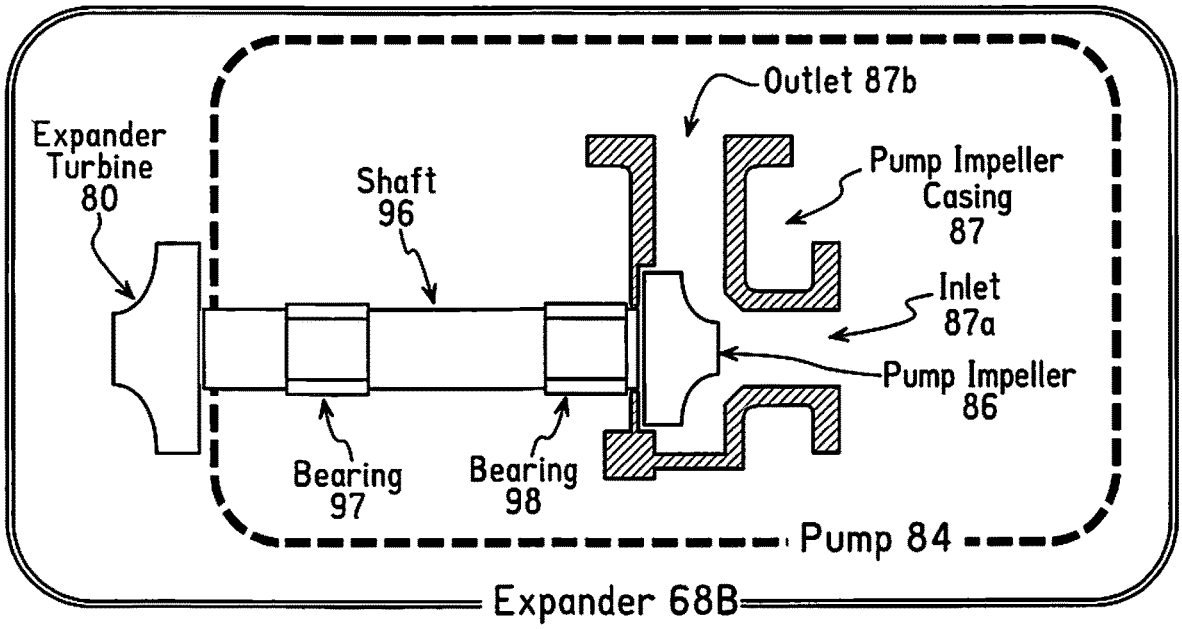
FIG. 13B is a schematic cross-sectional view of the expander used as a pump illustrated in FIG. 10B.

Referring to FIGS. 12B and 13B, the expander 68B basically includes an expander turbine 80 and a pump 84. The expander turbine 80 is disposed inside the expander turbine casing 81. The pump 84 includes a pump impeller 86, and the pump impeller 86 is disposed inside a pump impeller casing 87. The pump impeller casing 87 has an inlet 87*a* and outlet 87*b*. The expander 68B further includes a casing (not shown) which connects the expander turbine casing 81 and the pump impeller casing 87. The pump 84 further includes a shaft 96. The shaft 96 is rotatable about a rotation axis extending along a longitudinal direction of the shaft 96. The shaft 96 is attached to the expander turbine 80 at one end thereof, and is attached to the pump impeller 86 at the other end thereof. In this manner, the expander turbine 80 and the pump 84 are connected with each other via the shaft 96. A bearing 97 and a bearing 98 are disposed to rotatably support the shaft 96. The bearings 97 and 98 are conventional, and thus, will not be discussed and/or illustrated in detail herein. It will be apparent to those skilled in the art that any suitable bearing can be used without departing from the present invention.

In operation, the expander turbine 80 is rotated by work imparted from the refrigerant, and the rotation of the expander turbine 80 is transmitted to the pump impeller 86 via the shaft 96. The pump impeller 86 drives the flow of the refrigerant introduced from the inlet 87*a* of the expander impeller casing 87 toward the outlet 87*b* of the expander impeller casing 87. The refrigerant leaving the outlet 87*b* is introduced into the evaporator to be circulated therethrough. The refrigerant is then introduced into inlet 87*a* again for another circulation. In this manner, the expander 68B is used as a pump driven by energy obtained in the expansion process of the refrigerant to recirculate the refrigerant through the evaporator. In particular, the expander 68B is preferably applied to a case in which the evaporator is a falling film evaporator. In a falling film evaporator, liquid refrigerant is deposited onto exterior surfaces of heat transfer tubes from above so that a layer or a thin film of the liquid refrigerant is formed along the exterior surfaces of the heat transfer tubes, which requires a circulation of the refrigerant.

The chiller system 10 may include a chiller controller. The chiller controller is conventional, and thus, will not be discussed and/or illustrated in detail herein. The chiller controller may include at least one microprocessor or CPU, an Input/output (I/O) interface, Random Access Memory (RAM), Read Only Memory (ROM), a storage device (either temporary or permanent) forming a computer readable medium programmed to execute one or more control programs to control the chiller system 10. The chiller controller may optionally include an input interface such as a keypad to receive inputs from a user and a display device used to display various parameters to a user.

In terms of global environment protection, use of new low GWP (Global Warming Potential) refrigerants such like R1233zd, R1234ze are considered for chiller systems. One example of the low global warming potential refrigerant is low pressure refrigerant in which the evaporation pressure is equal to or less than the atmospheric pressure. For example, low pressure refrigerant R1233zd is a candidate for centrifugal chiller applications because it is non-flammable, non-toxic, low cost, and has a high COP compared to other candidates such like R1234ze, which are current major refrigerant R134a alternatives. Such low pressure refrigerant can be used for the turbo economizer in accordance with the present invention. However, various kinds of low pressure refrigerants can be used for the turbo economizer in accordance with the present invention, and it is not limited to the low pressure refrigerant.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

The term "detect" as used herein to describe an operation or function carried out by a component, a section, a device or the like includes a component, a section, a device or the like that does not require physical detection, but rather includes determining, measuring, modeling, predicting or computing or the like to carry out the operation or function.

The term "configured" as used herein to describe a component, section or part of a device includes hardware and/or software that is constructed and/or programmed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A turbo economizer adapted to be used in a chiller system including a compressor which is a multi-stage centrifugal compressor including at least a first stage and a second stage, an evaporator, and a condenser connected to form a refrigeration circuit, the turbo economizer comprising:

a nozzle configured and arranged to introduce refrigerant into the turbo economizer;

a turbine disposed downstream of the nozzle, the turbine being attached to a shaft rotatable about a rotation axis, and a flow of the refrigerant introduced through the nozzle driving the turbine to rotate the shaft, the turbine being configured and arranged to separate the refrigerant introduced through the nozzle into gas refrigerant and liquid refrigerant;

a turbine gas outlet arranged to discharge the gas refrigerant from the turbine;

a turbine liquid outlet arranged to discharge the liquid refrigerant from the turbine, the turbine liquid outlet being different from the turbine gas outlet; and an economizer impeller attached to the shaft so as to be rotated in accordance with rotation of the shaft, the turbo economizer being connected to an intermediate stage of the compressor located between the first stage and the second stage of the compressor, the nozzle being further configured and arranged to reduce a pressure of the refrigerant such that a pressure of the refrigerant entering the turbo economizer is lower than an intermediate pressure in the intermediate stage of the compressor, the turbine gas outlet being connected to an inlet of the economizer impeller to introduce gas refrigerant separated at the turbine into the economizer impeller, and the economizer impeller being configured and arranged such that the gas refrigerant is introduced into the economizer impeller at a pressure lower than the intermediate pressure and exits the economizer impeller at the intermediate pressure.

2. The turbo economizer according to claim 1, wherein the turbo economizer is refrigerant-powered without using a separate motor in which the turbine is driven by the flow of the refrigerant and the economizer impeller is driven by motive power from the turbine.

3. The turbo economizer according to claim 1, wherein the nozzle is further configured and arranged to increase a flow velocity of the refrigerant.

4. The turbo economizer according to claim 1, wherein the turbine is configured and arranged to reduce a flow velocity of the refrigerant.

5. The turbo economizer according to claim 1, wherein the turbine is a Pelton wheel turbine.

6. The turbo economizer according to claim 1, further comprising a bearing rotatably supporting the shaft.

7. The turbo economizer according to claim 1, further comprising an expander disposed downstream of the turbine, the expander being configured and arranged to perform an expansion process on the refrigerant introduced therein, and the refrigerant which has undergone the expansion process is introduced to the evaporator in the chiller system.

8. The turbo economizer according to claim 7, wherein the expander includes at least one expander impeller.

9. The turbo economizer according to claim 7, wherein the expander is used as a power generator driven by energy obtained in the expansion process of the refrigerant.

10. A chiller system comprising:

a refrigeration circuit including a compressor which is a multi-stage centrifugal compressor including at least a first stage and a second stage, an evaporator, and a condenser connected together; and a turbo economizer, the turbo economizer including a nozzle configured and arranged to introduce refrigerant into the turbo economizer, a turbine disposed downstream of the nozzle, the turbine being attached to a shaft rotatable about a rotation axis, and a flow of the refrigerant introduced through the nozzle driving the turbine to rotate the shaft, the turbine being configured and arranged to separate the refrigerant introduced through the nozzle into gas refrigerant and liquid refrigerant;

a turbine gas outlet arranged to discharge the gas refrigerant from the turbine;

a turbine liquid outlet arranged to discharge the liquid refrigerant from the turbine, the turbine liquid outlet being different from the turbine gas outlet; and an economizer impeller attached to the shaft so as to be rotated in accordance with rotation of the shaft, the turbo economizer being connected to an intermediate stage of the compressor located between the first stage and the second stage of the compressor, the nozzle being further configured and arranged to reduce a pressure of the refrigerant such that a pressure of the refrigerant entering the turbo economizer is lower than an intermediate pressure in the intermediate stage of the compressor, the turbine gas outlet being connected to an inlet of the economizer impeller to introduce gas refrigerant separated at the turbine into the economizer impeller, and the economizer impeller being configured and arranged such that the gas refrigerant is introduced into the economizer impeller at a pressure lower than the intermediate pressure and exits the economizer impeller at the intermediate pressure.

11. The chiller system according to claim 10, wherein the turbo economizer is disposed between the evaporator and the condenser in the chiller system.

12. The chiller system according to claim 10, wherein the turbo economizer further includes an expander disposed downstream of the turbine, and the expander is configured and arranged to perform an expansion process on the refrigerant introduced therein such that the refrigerant which has undergone the expansion process is introduced to the evaporator in the chiller system.

13. The chiller system according to claim 12, wherein the expander is used as a power generator driven by energy obtained in the expansion process of the refrigerant.

14. The chiller system according to claim 12, wherein the evaporator is a falling film evaporator, and the expander is used as a pump driven by energy obtained in the expansion process of the refrigerant to circulate the refrigerant through the falling film evaporator.

* * * * *